US006051356A

United States Patent [19]

Nishihara et al.

[11] Patent Number: 6,051,356

[45] Date of Patent: Apr. 18, 2000

[54] TONER FOR ELECTROSTATIC LATENT IMAGE DEVELOPING

[75] Inventors: Yoshikazu Nishihara, Itami; Ichiro Demizu, Toyonaka; Yoshihiro Mikuriya, Amagasaki; Hiroshi Fukao, Toyonaka; Fumiko Hirano, Fukuroi; Hiroyuki Fukuda, Kobe, all of Japan

[73] Assignee: Minolta Co., Ltd., Osaka, Japan

[21] Appl. No.: 09/038,907

[22] Filed: Mar. 12, 1998

[30] Foreign Application Priority Data

Mar. 12, 1997 [JP] Japan ..... 9-057981
Nov. 6, 1997 [JP] Japan ..... 9-304505

[51] Int. Cl.[7] ..... G03G 9/087

[52] U.S. Cl. ..... 430/110; 430/137

[58] Field of Search ..... 430/106, 109, 430/111, 137

[56] References Cited

U.S. PATENT DOCUMENTS 5,863,694 1/1999 Sano et al. ..... 430/111
5,932,386 8/1999 Anno et al. ..... 430/137

FOREIGN PATENT DOCUMENTS 49-65231 10/1972 Japan .
04313762 5/1992 Japan .

*Primary Examiner*—John Goodrow
*Attorney, Agent, or Firm*—McDermott, Will & Emery

[57] ABSTRACT

A toner is provided for electrostatic latent image developing which exhibits desirable smearing, offset and filming characteristics during copying, and which has excellent toner flow characteristics and chargeability properties. The toner of the present invention contains at least a binder resin containing polyethylene wax, and at least polypropylene wax, and colorant. The toner of the present invention is made by a process whereby polyethylene wax is added to a binder resin to form a mixture. The mixture is then added or mixed with a colorant and polypropylene wax.

17 Claims, No Drawings

TONER FOR ELECTROSTATIC LATENT IMAGE DEVELOPING

FIELD OF THE INVENTION

The present invention relates to toners used to develop an electrostatic latent images formed on photosensitive members in image forming apparatuses such as copiers, printers and the like. The present invention relates to Japanese Patent Application Nos. 09-057981 and 09-304505, the entire contents of which are incorporated herein by reference.

BACKGROUND OF THE INVENTION

Conventional toners for electrostatic latent image developing are typically manufactured using kneading and classifying methods by fusion-kneading a toner structural component, such as colorant and the like, in a binder resin, followed by cooling and solidifying the kneaded material, and then subsequently pulverizing and classifying said material. Pressure fixing methods, flash fixing methods, oven fixing methods and similar non-contact heat-fixing methods, heating roller fixing methods and similar contact heat-fixing methods are conventionally used as toner fixing methods in image forming apparatuses, such as electrophotographic apparatuses. In particular, contact heat-fixing methods are the most widely used fixing methods because they are capable of high speed fixing compared to pressure fixing methods, have a high thermal efficiency compared to non-contact heat fixing methods, are capable using a relatively low temperature heat source, and can be employed in compact and energy efficient devices.

In recent years, electrophotographic apparatuses using contact-type heat fixing methods have required ever more high-speed and energy efficient operation. If low temperature fixing is realized, not only is the electrophotographic apparatus more energy efficient, warm up time can also be reduced so as to provide optimal operational characteristics. In such contact-type heat fixing methods, for example, a disadvantage arises in that a so-called offset phenomenon may occur during fixing of a toner image via heating roller fixing methods when a portion of the toner comprising an image adheres to the surface of said heating roller and is subsequently transferred back to a transfer sheet transported thereto. As a result, the image becomes undesirably soiled. Japanese Laid-Open Patent Application No. 49-65231 discloses preventing the offset phenomenon by adding, for example, polypropylene wax as an anti-offset agent (i.e., separation agent).

In recent years, copiers provided with auto document feeders and duplex copying devices have become standard in conjunction with multifunctionality and higher speed electrophotographic copying speeds. Problems such as bleeding and soiling of an image, however, often arise in such apparatuses when the surface of the copy image is rubbed by a roller during document transport, or sheet transport during the second copying process of second-side copying, and multi-color copying. Other similar image quality problems occur when transfer sheets designated for multiple copy overlays are temporarily held within the apparatus and subsequently fed one sheet at a time by a feed roller to receive the second copy. Toners that are subject to the aforesaid disadvantages are said to have poor smearing characteristics. To improve smear characteristics, it has been disclosed that polyethylene wax may be added during the kneading process (e.g., Japanese Laid-Open Patent Application No. 4-313762).

However, when polypropylene wax and polyethylene wax are simultaneously added during the kneading process of the above-mentioned kneading-pulverization methods to improve simultaneously the offset characteristics and smear characteristics of a toner, other problems or disadvantages occur. For instance, filming may occur during copying, thereby reducing toner flow characteristics and chargeability. By using polypropylene wax and polyethylene wax together, the compatibility of said materials with the binder resin becomes adversely affected. For instance, waxes, and particularly polyethylene wax is freed, resulting in said free wax adhering to the photosensitive member and causing filming of said member, thereby adversely affecting toner flow characteristics and chargeability.

Accordingly there remains a need for better and reliable toners, and methods for making toners that address the above problems and disadvantages and that provide a toner having, for example, desirable smearing, offset, filming, flow and chargeability characteristics.

SUMMARY OF THE INVENTION

The present invention relates to a toner for electrostatic latent image developing comprising a binder resin composition containing at least polyethylene wax added when forming the binder resin, and at least a polypropylene wax, and a colorant.

Accordingly, it is an object of the present invention is to provide a toner for electrostatic latent image developing, and a method for making such toner, which prevents smearing, offset, and filming during copying, and provides excellent toner flow characteristics and chargeability.

In accordance with these and other objects, the present invention is directed to a toner of the present invention comprising a binder resin, said binder resin containing a polyethylene wax added during the binder resin formation, a polypropylene wax, and a colorant. The toner of the present invention is produced by a method comprising the steps of mixing a resin with a polyethylene wax to form a binder resin containing the polyethylene wax; and mixing the binder resin containing the polyethylene wax with a polypropylene wax and a colorant.

Additional objects and advantages of the present invention will be set forth, in part, in the description and examples that follow, or may be learned from practicing or using the present invention. These and other objects and advantages may be realized and attained by means of the features, instrumentalities and/or combinations particularly described herein. It is to be understood that the foregoing general description and the following detailed description are only exemplary and explanatory in nature and are not to be viewed as limiting or restricting the present invention, as claimed.

DETAILED DESCRIPTION OF PREFERRED EMBODIMENTS

It is noted that all patents, patent applications and literatures that may be cited in this application are incorporated herein by reference in their entirety.

It has been discovered that in a manufacture method of a toner of the present invention, the addition and mixing of a high or low molecular weight polyethylene wax with a binder resin followed by, or prior to, the addition (through kneading/pulverizing) of other toner components, such as a polyethylene wax, a colorant, etc., provides a toner for electrostatic latent image developing having excellent flow characteristics and chargeability without causing copy image smearing, offset, or filming. Such desirable characteristics are unexpectedly achieved in the toner of the present invention even though it contains both polyethylene wax and polypropylene wax. Without wishing to be bound thereby, it is believed that such a method achieves desirable anti-offset toner characteristics through the uniform dispersion of the polyethylene wax and polypropylene wax contained therein.

In a preferred embodiment, the toner of the present invention comprises a resin composition containing a polyethylene wax added when forming a binder resin, and a polypropylene wax, and a colorant. The polyethylene wax in the resin composition has a small particle size and is uniformly dispersed in the binder resin.

According to the principles of the present invention, the polyethylene wax used in the present invention has a softening point within a range of about 100° to about 150° C., preferably about 110° to about 145° C., and more preferably about 120° to about 140° C. When the softening point of the polyethylene wax is less than about 100° C., heat resistance is adversely affected, and filming readily occurs. Conversely, when the softening point exceeds about 150° C., smear characteristics are reduced. Although either high viscosity or low viscosity polyethylene wax may be used, high viscosity polyethylene wax is more preferred if improved smear characteristics are desired.

The polyethylene wax may be a vinyl monomer-graft polyethylene, which may be obtained by graft polymerization of vinyl monomer, high-pressure polymerized polyethylene wax obtained by radical polymerization of ethylene at high pressure or thermally decomposed high-pressure-processed polyethylene, or neutral or low pressure polymerization of ethylene, or ethylene and propylene, and α-olefin such as 1-butene, 1-hexene, 4-methyl-1-pentene, 1-decene and the like as a transition metal compound catalyst.

It should be appreciated that vinyl monomer graft polyethylene wax not only provides excellent compatibility between said monomer from which the polyethylene wax is constructed and a binder resin such as styrene polymer, but also provides excellent compatibility or affinity with various additives such as pigments and dyes, charge controller, plasticizer and the like. Therefore, the addition of such polyethylene wax in the resin composition increases the dispersibility of these additives in the binder resin, increases the physical uniformity of the toner relative to charge controller and the like, and improves performance of the toner/developer.

In the present invention, the polyethylene wax comprises about 0.1 to bout 5.0 parts-by-weight (hereinafter abbreviated as "pbw"), preferably about 0.3 to about 4.0 pbw, and more preferably about 0.5 to about 3.0 pbw, relative to about 100 pbw of the monomer constructing the binder resin. When the polyethylene wax content is less than about 0.1 pbw, inadequate effectiveness in preventing smearing is observed, whereas when the content exceeds about 5.0 pbw, filming readily occurs and toner flow characteristics tend to decline.

Further the polyethylene wax is mixed, or otherwise incorporated, with the binder resin at the time of its formation. Therefore, by adding to, and mixing with, the binder resin when said binder resin is being formed, said polyethylene possesses a small particle size and is uniformly dispersed such that the amount of said wax exposed on the surface of the toner and the amount of wax eliminated or lost from the toner are reduced. As a result, it is believed that a decline in toner flow characteristics and chargeability, as well as smearing during the copying process caused by free polyethylene wax, which have been disadvantageous in conventional toners, and the simultaneous provision of polyethylene wax and polypropylene wax in the toner effectively enhances the anti-smearing and anti-offset characteristics of the resulting toner/developer.

In accordance with the principles of the present invention, the polyethylene wax is added to, and mixed with, a polymer solution after polymerization of a structural monomer (hereinafter referred to as "monomer") and a binder resin. Thereafter, the polymer solution containing a dispersion of polyethylene wax has the solvent removed therefrom to obtain a resin composition having a dispersion of polyethylene wax in a binder resin.

Suitable polymerization methods that may be used in accordance with the principles of the present invention include, but are not limited to, conventional methods used in the manufacture of binder resins, for example, bulk polymerization, solution polymerization, suspension polymerization, emulsion polymerization and the like. The polymerization method employed will depend on the selected target binder resin type, molecular weight, and molecular weight distribution. In addition, such methods may also be used in any suitable combination. Although polymerization conditions identical to the parameters used to obtain conventional binder resins may be used, it is merely routine to optimally set the polymerization temperature, polymerization time, solvent and the like to obtain a desired binder resin molecular weight to produce the toner of the present invention. Further, the methods used to disperse the polyethylene wax is not specifically restricted insofar as such methods provide small particle sizes, specifically a mean particle size of less than about 20 μm, and preferably about 0.1 μm to about 5 μm, which does not cause precipitation of the polyethylene wax. It is noted that when the dispersion particle size of the polyethylene wax is too large, the effect of the present invention is inadequately realized because of the undesirable occurrence of free polyethylene wax in the subsequent toner manufacturing process.

In a preferred embodiment, a polyethylene wax is added during the formation of a binder resin by mixing the polyethylene wax with the monomer solution containing a monomer before polymerization of said monomer. Thereafter, the aforesaid monomer is polymerized as the polyethylene wax is being dispersed, to obtain a polymer solution having a dispersion of polyethylene wax therein, then the solvent is removed to obtain a resin composition. Polymerization methods and polymerization conditions may be identical to those used when polyethylene wax is added after the monomer is polymerized. Regarding the polyethylene wax dispersion method, since the viscosity of the solution to which the wax is to be added is different when the wax is added prior to monomer polymerization and when added after monomer polymerization, i.e., the solution viscosity is greater when the wax is added after monomer polymerization than when added prior to monomer polymerization, the mixing speed must be set higher than in the former instance, or the mixing time must be increased, but in either case it is preferred for the polyethylene wax to be dispersed in a small particle size which will not precipitate.

The binder resin used in the present invention may be any binder resin used in conventional toners, which include, without limitation, styrene copolymer resin, polyester resin, epoxy resin, and the like. In the present invention as described above, a polyethylene wax is added to and mixed during the formation of the binder resin so as to achieve a uniform dispersion of relatively small particle size wax in the binder resin and obtain a resin composition containing polyethylene wax.

Examples of suitable monomers in the aforesaid binder resin of the present invention include, but are not limited to, members selected from the consisting of styrene monomer, acrylic monomer, methacrylic monomer, vinyl monomer, polycarboxylic monomer, polyhydroxy monomer, epoxy monomer, polyester monomer and mixtures thereof. According to the present invention, binder resins constructed by the aforesaid monomers desirably have a number-average molecular weight (prior to the addition of the polyethylene wax) of about 2,000 to about 10,000, preferably about 2,500 to about 7,000, and a weight-average molecular weight/number-average molecular weight ratio of about 20 to about 90, and preferably about 25 to about 85, as measured by gel permeation chromatography. It is noted that if the number-average molecular weight is less than about 2,000, then heat resistance is reduced and offset readily occurs. Moreover, if the number-average molecular weight exceeds about 10,000, then fixing strength is reduced. Further, offset characteristics decline when the weight-average molecular weight/number-average molecular weight ratio is less than about 20, and fixing strength is adversely affected when said ratio exceeds about 90.

The addition of styrene copolymer resin to the binder resin is particularly preferred and effective in achieving the objects of the present invention. Examples of styrene monomers that may be used to construct a styrene copolymer resin include, but are not limited to, styrene, α-methylstyrene, p-methylstyrene, p-tert-butylstyrene, p-chlorostyrene and like styrene monomers and derivatives thereof.

Examples of monomers that can be used in the copolymerization of styrene monomers include, but are not limited to, methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate, dodecylmethacrylate and like alkyl ester methacrylates; methylacrylate, n-propylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, dodecylacrylate and like alkyl ester acrylates; acrylate, methacrylate, itaconic acid, maleic acid and like unsaturated carboxylic acids, acrylonitrile, maleic acid ester, itaconic acid ester, vinylchloride, vinylacetate, vinylbenzoate, vinylmethylethyl ketone, vinylhexyl ketone, vinylmethyl ether, vinylethyl ether, vinylisobutyl ether and like vinyl monomers. Methacrylate alkyl esters (alkyl group having 1 to 17 carbon atoms) and acrylate alkyl esters (alkyl group having 1 to 17 carbon atoms) are desirable.

The acid value of the aforesaid binder resin is preferably considered to improve the dispersibility of polyethylene wax, polypropylene wax, and colorant. For example, when styrene copolymer resin is used as a binder resin, the acid value can be controlled by adjusting the amount of unsaturated carboxylic acid, e.g., (meth)acrylate. The acid value will desirably be about 1 to about 30 KOH mg/g, and more preferably about 3 to about 10 KOH mg/g.

In a preferred embodiment, a monomer is polymerized to obtain a low molecular weight polymer solution. Polyethylene wax is then added to the polymer solution and thoroughly dispersed to produce a low molecular weight polymer solution containing a dispersion of polyethylene wax. Thereafter, this low molecular weight polymer solution containing a dispersion of polyethylene wax is mixed with a high molecular weight polymer solution to re-disburse said polyethylene wax, and the solvent is removed to obtain a resin composition of small particle polyethylene wax uniformly dispersed in binder resin.

In another preferred embodiment, polyethylene wax is first added to, and mixed with, a polymer solution containing a monomer so as to be dispersed therein, then said monomer is polymerized to obtain a low molecular weight polymer solution containing a dispersion of polyethylene wax. Optionally, a monomer of the same type is polymerized in a separate vessel to obtain a high molecular weight polymer solution. Thereafter, the low molecular weight polymer solution containing a dispersion of polyethylene wax is mixed with the high molecular weight polymer solution so as to re-disperse the polyethylene wax, then the solvent is removed to obtain a resin composition having small particles of polyethylene wax uniformly dispersed in a binder resin.

The resin composition described above is subjected to conventional kneading and pulverization processes with at least a polypropylene wax and colorant. It is undesirable to add the polypropylene wax together with the polyethylene wax when forming the binder resin inasmuch as prevention of offset is insufficiently effective when the polypropylene wax is present in the resin composition.

The polypropylene wax has a softening point of about 130° to about 160° C., and preferably about 140° to about 155° C., and more preferably about 145 to about 155° C. When the softening point is less than about 130° C., not only is heat resistance reduced, filming also readily occurs. On the other hand, when the softening point exceeds about 160° C., offset characteristics decline. High-temperature offset is effectively prevented when the polypropylene wax has a higher softening point than does the polyethylene wax used concomitantly, with said softening point difference being about 25° C.

The total added amount of polyethylene wax and polypropylene wax described later is within a range of about 2 to about 10 pbw, preferably about 3 to about 9 pbw, and more preferably about 3 to about 8 pbw, relative to about 100 pbw of binder resin. If the total amount of added polyethylene wax and polypropylene wax is less than the aforesaid range, then offset characteristics and smearing characteristics are reduced, whereas if said range is exceeded, then toner flow characteristics are adversely affected and filming readily occurs. in the following description, about 100 pbw of binder resin is defined as the weight of only the binder resin present in the resin composition.

The ratio of added polyethylene wax to polypropylene wax is within a range of about 10:1 to about 1:10, preferably about 10:1 to about 1:2, and more preferably about 10:1 to about 1:1.3. It is noted that if the ratio of added polyethylene wax is less than the aforesaid range, then smearing readily occurs, whereas if the ratio exceeds said range, then offset characteristics decline.

Any suitable colorant may be used in accordance with the principles of the present invention, including, without limitation, colorants used in conventional electrophotography.

Examples of usable black pigments include, without limitation, carbon black, copper oxide, manganese dioxide, aniline black, active carbon, ferrite, magnetite and the like.

Examples of usable yellow pigments include, without limitation, chrome yellow, zinc yellow, cadmium yellow, yellow oxide, mineral fast yellow, nickel-titanium yellow, Naples yellow, naphthol yellow S, Hansa yellow G, Hansa yellow 10G, benzidine yellow G, benzidine yellow GR, quinoline yellow lake, permanent yellow NCG, tartrazine yellow lake and the like.

Examples of useful red pigments include, without limitation, chrome orange, molybdenum orange, permanent orange GTR, pyrazolone orange, Vulcan orange, indanthrene brilliant orange RK, benzidine orange G, indanthrene brilliant orange GK, red oxide, cadmium red, red lead, permanent red 4R, lithol red, pyrazolone red, Watchung red, lake red C, lake red D, brilliant carmine 6B, eosin lake, rhodamine lake B, alizarin lake, brilliant carmine 3B, permanent orange GTR, Vulcan fast orange GG, permanent red F4RH, permanent carmine FB and the like.

Examples of useful blue pigments include, without limitation, Prussian blue, cobalt blue, alkali blue lake, Victoria blue lake, phthalocyanine blue and the like.

Although the amount of added colorant is not specifically limited, it is preferred that the colorant is added at a rate of about 1 to about 20 pbw, and preferably about 3 to about 15 pbw, relative to about 100 pbw of binder resin.

The toner of the present invention may contain other additives, including, without limitation a charge controller, magnetic powder and the like. A positive charge controller may be used when positive charging of the toner is desired, and a negative charge controller may be used when negative charging of the toner is desired. Suitable positive charge controllers usable in the present invention include, without limitation, nigrosine dye, triphenylmethane compound, quaternary ammonium salt compounds and the like. Suitable triphenyl methane compounds are disclosed in Japanese Laid-Open Patent Application Nos. 51-11455, 59-100457, and 61-124955. Examples of usable quaternary ammonium salt compounds are disclosed in Japanese Laid-Open Patent Application No. 4-70849. Suitable negative charge controllers include, without limitation, metal salicylic acid complex, metal-containing azo dye, calyx allene compound, boron-containing compounds and the like. In accordance with the principles of the present invention, the aforesaid charge controllers may be used individually or in combinations of two or more. The amount of added charge controller is desirably about 0.5 to about 10 pbw relative to about 100 pbw of binder resin.

Examples of usable magnetic powders include, without limitation, ferrite, magnetite, and iron powder used individually or in combination. Adding magnetic powder prevents filming, and is greatly effective in preventing airborne dispersion and spilling via magnetic force.

In order to prevent reduction in chargeability due to inadequate dispersion of the magnetic powder in the toner of the present invention, a BET specific surface area of about 2 to about 15 $m^2/g$ is desired, with about 5 to about 12 $m^2/g$ being more desirable.

The amount of added magnetic powder in the present invention is within a range of about 0.5 to about 20 pbw, and desirably about 1 to about 10 pbw, relative to about 100 pbw of binder resin. When the amount of added magnetic powder exceeds about 20 pbw, image density is reduced to a decline in developing characteristics.

The toner for electrostatic latent image developing of the present invention can be readily manufactured using known kneading-pulverization methods. A mixture comprising at least the resin composition containing polyethylene wax produced in the manner described above, colorant, and polypropylene wax and other additives may be kneaded by an extrusion kneading device, the kneaded material cooled to solidify, and subsequently pulverized and classified to obtain toner particles having a mean particle size of about 5 to about 14 $\mu$m, and preferably about 6 to about 12 $\mu$m. Fluidizing agent and cleaning agent may be added to the obtained toner particles, as desired, to produce the toner of the present invention. In the pulverization process, the kneaded material may be coarsely kneaded to less than about 2 mm using a pulverizer such as a feather mill, then the particles may be finely pulverized to a desired particle size using a mechanical pulverizer or other suitable means.

In the toner of the present invention both the polyethylene wax and polypropylene wax are dispersed as small size particles within the toner particles, and the both the polyethylene wax and polypropylene wax have similar characteristics. Preferably, the fine particles of polypropylene wax contained in the toner particles will be such that about 2 to about 50%, and preferably about 2 to about 38% of said particles will have a particle size of about 2 $\mu$m or greater. When the content of said particle size is less than about 2.0%, offset characteristics are adversely affected. When said particle size content exceeds about 50%, filming readily occurs, and so-called image fog is likely to occur.

The particle size of the polyethylene wax contained in the toner will be such that less than about 3.0%, and desirably less than about 2.0%, and more desirably less than about 1.5%, of said particles, will have a particle size of about 2 $\mu$m or greater. When the content of said particle size is greater than about 2.0%, filming readily occurs, and image fog is likely to occur.

Values measured by the method described below were used as the particle size dispersion measurement of the aforesaid wax particles. A sample of about 0.1 g toner was dissolved in about 25 ml of chloroform and centrifuged to separate the wax, then the collected wax was again added to about 25 ml of chloroform and centrifuged to again separate the wax which was subsequently collected. Thereafter, the fine wax particles were photographed using a scanning electron microscope (SEM) at about 3,000 times magnification, and the particle size was calculated. The photographed wax was heated to a temperature above the softening point of the polyethylene wax, but below the softening point of the polypropylene wax, then cooled, and re-examined via the SEM to differentiate the polyethylene wax and the polypropylene wax.

Examples of suitable fluidizers, which may be added in accordance with the principles of the present invention, include, without limitation, silica fine particles, titanium dioxide fine particles, alumina fine particles, magnesium fluoride fine particles, silicon carbide fine particles, boron carbide fine particles titanium carbide fine particles, zirconium carbide fine particles, boron nitride fine particles titanium nitride fine particles, zirconium nitride fine particles, magnetite fine particles, molybdenum sulfide fine particles, aluminum stearate fine particles, magnesium stearate fine particles, zinc stearate fine particles and the like. The aforesaid fine particles may be used for hydrophobic processing with a silane coupling agent, titanium coupling agent, higher fatty acid, silicone oil and the like.

The amount of added fluidizing agent is within a range of about 0.05 to about 5 pbw, and desirably about 0.1 to about 3 pbw, relative to about 100 pbw of binder resin.

Examples of useful cleaning agents include, but are not limited to, various types of organic fine particles such as styrene, acrylic, methacrylic, benzoguanamine, silicone, teflon, polyethylene, polypropylene and the like granulated vapor-phase methods or wet methods such as emulsion polymerization, soap-free emulsion polymerization, non-aqueous dispersion polymerization and the like, said materials being used individually or in combinations of two or more. The added amount is will preferably be about 0.01 to about 1 part-by-weight relative to about 100 pbw of binder resin.

The toner for electrostatic latent image developing of the present invention produced in the manner described above may be used in a monocomponent developer without a carrier, more preferably in a two-component developer with a carrier. Well known carriers may be used with the toner of the present invention, for example, carriers comprising iron powder, ferrite powder and the like, coated carriers comprising magnetic particles whose surface is coated with a coating such as resin or the like, or dispersion-type carriers comprising magnetic powder dispersed in binder resin. Such carriers will have a volume-average particle size of about 15 to about 100 $\mu$m, and desirably about 20 to about 80 $\mu$m.

Desirable carriers when the toner of the present invention is used as a positive charging toner are carriers which have chargeability relative to the toner, i.e., carriers having a negatively chargeable resin on the surface of the carrier. Examples of such negatively chargeable resins include, without limitation, polyester resin, polyolefin resins such as polyethylene and the like, homopolymers tetrafluoroethylene, vinylidenefluoride, fluorine-containing vinyl monomer and the like, or fluororesins such as other vinyl monomers and copolymers thereof. Preferred carriers, however, are formed with the aforesaid negatively chargeable resin coating, or carriers comprising magnetic powder dispersed in a negatively chargeable resin from the perspective of chargeability when combined with the toner of the present invention.

When the toner of the present invention is used as a negatively chargeable toner, it is desirable that a positively chargeable resin is present on the surface of the carrier. Examples of such resins include, without limitation, acrylic resin, styrene-acrylic resin, silicone resin and the like.

The advantages of the present invention will be further illustrated in the following, non-limiting Examples. The Examples merely illustrate embodiments of the present invention and are not intended to limit the claimed invention regarding the materials, conditions, process parameters and the like recited herein.

EXAMPLE 1

A solution of 70 pbw styrene, 14 pbw butylacrylate, 14 pbw butylmethacrylate, 2 pbw methacrylate, and 3 pbw catalyst were continuously titrated into 100 pbw xylene and polymerized to produce a low molecular weight polymer solution. To this polymer solution was added 4 pbw polyethylene wax (Hiwax 800P; Mitsui Sekiyu Kagaku K.K.) and thoroughly dispersed.

On the other hand, after 70 pbw styrene, 14 pbw butylacrylate, 14 pbw butylmethacrylate, and 2 pbw methacrylate were polymerized by bulk polymerization at 120° C., xylene and catalyst were added and the solution was subjected to solution polymerization to produce a high molecular weight polymer solution. After the low molecular weight polymer solution and the high molecular weight polymer solution were mixed in a resin weight ratio of 1:1, polyethylene wax was dispersed therein by mixing. Thereafter, the organic solvent was removed, and the obtained resin was cooled and solidified, then pulverized to produce a resin composition. The binder resin produced by the same method without polyethylene wax had a number-average molecular weight (Mn) of 4,000, weight-average molecular weight/number-average molecular weight ratio (Mw/Mn) of 68.8, softening point of 121.8° C., and acid value of 6.5 KOH mg/g.

Resin composition: 100 pbw (comprising 98.04 pbw binder resin and 1.96 pbw polyethylene wax (converted value))

Polypropylene wax: 4 pbw (softening point 145° C.; Biscol 660P; Sanyo Kasei K.K.)

Carbon black: 10 pbw (Mogul-L; Cabot)

Nigrosine dye: 5.0 pbw (Nigrosine base EX; Orient Chemical Industries)

Quaternary ammonium salt: 0.5 pbw (P-53; Orient Chemical Industries)

Magnetic powder: 2 pbw (MFP-2; TDK K.K.)

The above materials were thoroughly mixed for 3 min at 3,000 rpm using a Henschel mixer (capacity: 75 liters). The mixture was continuously extrusion kneaded using a screw-type extrusion kneading device (model TEM 50; Toshiba Kikai K.K.) at 120° C., supply rate of 30 kg/hr, screw rpm of 150 rpm, then press rolled using pressure rollers set at a I mm slit gap, and forced water cooled using a belt cooler. The kneaded material was then coarsely pulverized using a feather mill (2 mm mesh). The coarsely pulverized material was then finely pulverized to 11 $\mu$m using a mechanical pulverizer (model Krypton KTM-O; Kawasaki Heavy Industries), and coarse cut using a jet mill (model IDS-2; Japan Pneumatic) provided with a natural airflow classifier, then fine cut using a rotary type classifier (model 50-ATP classifier; Hosokawa Micron) to obtain toner particles having a volume-average particle size of 11 $\mu$m. To these toner particles was added 0.15 pbw hydrophobic silica (R974; Aero-Sil Co. Ltd.) as a fluidizer to obtain the toner particles.

EXAMPLES 2–7 AND COMPARATIVE EXAMPLES 1–4

Toner was manufactured in the same manner as described in Example 1. Polymerization conditions were suitable set when manufacturing the resin composition. The binder resin having a resin composition without wax had a number-average molecular weight Mn, Mw/Mn ratio, softening point,, wax type and amount added during resin formation (conversion value), wax type and amount added during toner mixing, and percentage of wax particles of a size 2 $\mu$m and greater shown in Tables 1 and 2.

EXAMPLE 8

Toner was manufactured in the same manner as in example 1 with the exception that the resin composition and methods described below were used.

A solution of 70 pbw styrene, 14 pbw butylacrylate, 14 pbw butylmethacrylate, 2 pbw methacrylate, and 5 pbw polyethylene wax (Hiwax 100P; Mitsui Sekiyu Kagaku K.K.) were added 100 pbw xylene and thoroughly dispersed, then 3 pbw catalyst was added by continuous titration and polymerized to produce a low molecular weight polymer solution.

On the other hand, after 70 pbw styrene, 14 pbw butylacrylate, 14 pbw butylmethacrylate, and 2 pbw methacrylate were polymerized by bulk polymerization at 120° C., xylene and catalyst were added and the solution was subjected to solution polymerization to produce a high molecular weight polymer solution. After the low molecular weight polymer solution and the high molecular weight polymer solution were mixed in a resin weight ratio of 2:3, polyethylene wax was dispersed therein by mixing. Thereafter, the organic solvent was removed, and the obtained resin was cooled and solidified, then pulverized to produce a resin composition. The binder resin produced by the same method without polyethylene wax had a number-average molecular weight (Mn) of 4,500, weight-average molecular weight/number-average molecular weight ratio (Mw/Mn) of 83.4, softening point of 127.5° C., and acid value of 6.5 KOH mg/g. 100 pbw resin composition comprised 98.04 pbw binder resin and 1.96 pbw polyethylene wax.

The toners obtained in examples 1~8 and comparative examples 1~4 were mixed with a binder type carrier produced by the methods described below at a weight mix ratio (toner:carrier) of 5:95 to produce developers.

Production of Binder-type Carrier

| Component | pbw |
|---|---|
| Polyester resin (NE-1110; Kao K.K.) | 100 |
| Inorganic magnetic powder (MFP-2; TDK K.K.) | 500 |
| Carbon black (MA #8; Mitsubishi Kasei K.K.) | 2 |

The aforesaid materials were thoroughly mixed using a Henschel mixer, and pulverized the extrusion kneaded using an extrusion kneader set at 180° C. in the cylinder, and 170° C. in the cylinder head. The kneaded material was cooled, coarsely pulverized, then finely pulverized using a jet mill, and finally classified using an air classifier to obtain a magnetic carrier having a volume-average particle size of 55 μm.

Developers comprising toner and the aforesaid binder-type carrier were evaluated for the following criteria.

(1) Smearing

The aforesaid developers and copier (model EP4050; Minolta Co., Ltd.) were used to make copies. After the copy image was fixed on a copy sheet, the sheet bearing the copy image was rubbed using a new unused copy sheet and the degree of soiling of the unused copy sheet was observed and ranked as described below.

A: No soiling

B: Slight soiling which posed no practical problem

C: Severe soiling (2) Offset

Copies were made using the aforesaid copier modified to allow variable adjustment of the fixing temperature. The temperature of the fixing roller was elevated to near 250° C., and the temperatures at which offset occurred were ranked as described below.

A: No offset at 250° C.

B: No offset at less than 250° C.

C: Offset at less than 230° C.

(3) Filming

After 5,000 consecutive copies were made using the aforesaid copier (model EPS-4050; Minolta Co., Ltd.), half-tone images were produced and the photosensitive member was examined and its condition ranked as described below.

A: No toner adhered to photosensitive member; no image disturbance

B: Slight toner adherence on part of the surface of the photosensitive member, but no visible image disturbance C: Heavy toner adherence on entire surface of the photosensitive member with definite image disturbance Tables 1 and 2 shows the results of the aforesaid evaluations, as well as toner manufacturing conditions for the aforesaid examples and comparative examples. The amount of wax added to 100 pbw of resin is a value standardized on 100 pbw of total monomer weight; and the amount of wax added during toner kneading is a value standardized on 100 pbw resin composition manufactured in the examples and comparative examples. The amount of wax added during toner kneading is expressed as a conversion value of the value standardized on 100 pbw binder resin. Since the binder resin in the resin composition used in the examples and comparative examples are addition polymers, the monomer total weight and binder resin weight are equal. The added amounts and ratios of the polyethylene wax (PE) and polypropylene wax (PP) relative to resin are shown in Table 3 to facilitate understanding.

TABLE 1

| | Binder Resin | | | Added wax per 100 pbw resin | | Added wax during toner kneading | | Percentage wax particles 2 μm or larger | | Evaluations | | |
|---|---|---|---|---|---|---|---|---|---|---|---|---|
| | Mn | Mw/Mn | Softening pt. (° C.) | Type (softening pt.) | Amount added (pbw) | Type (softening pt.) | Amount added (pbw; converted value) | PP wax | PE wax | Smear | Offset | Filming |
| Ex 1 | 4000 | 68.8 | 121.8 | PE[23] (Hiwax 800P (140° C.)) | 2 | PP[33] (Biscol 660P (145° C.) | 4 (4.08) | 18.9% | 0.8% | A | A | A |
| Ex 2 | 4000 | 68.8 | 121.8 | PE (Hiwax 800P (140° C.)) | 0.5 | PP Biscol 660P (145° C.) | 4 (4.02) | 17.5% | 0.0% | B | A | A |
| Ex 3 | 4000 | 68.8 | 121.8 | PE (Hiwax 800P (140° C.)) | 3 | PP Biscol 660P (145° C.) | 3 (3.09) | 11.4% | 1.0% | A | A | A |
| Ex 4 | 4500 | 83.4 | 127.5 | PE (Hiwax 100P (121° C.)) | 2 | PP Biscol 660P (145° C.) | 6 (6.12) | 34.9% | 0.1% | A | A | A |
| Ex 5 | 2800 | 37.0 | 117.3 | PE (Hiwax 800P (140° C.)) | 4 | PP Biscol 330P (152° C.) | 3 (3.12) | 2.8% | 1.5% | A | B | B |

TABLE 1-continued

| | Binder Resin | | | Added wax per 100 pbw resin | | Added wax during toner kneading | | Percentage wax particles 2 μm or larger | | Evaluations | | |
|---|---|---|---|---|---|---|---|---|---|---|---|---|
| | Mn | Mw/Mn | Softening pt. (° C.) | Type (softening pt.) | Amount added (pbw) | Type (softening pt.) | Amount added (pbw; converted value) | PP wax | PE wax | Smear | Offset | Filming |
| Ex 6 | 4000 | 68.8 | 121.8 | PE (Hiwax 400P (136° C.)) | 0.5 | PP Biscol 550P (150° C.) | 4 (4.02) | 29.2% | 0.8% | B | A | A |
| Ex 7 | 4000 | 68.8 | 121.8 | PE (Hiwax 100P (121° C.)) | 3 | PP Biscol 660P (145° C.) | 3 (3.09) | 10.7% | 1.4% | A | A | B |
| Ex 8 | 4500 | 83.4 | 127.5 | PE (Hiwax 100P (121° C.)) | 2 | PP Biscol 660P (145° C.) | 6 (6.12) | 37.3% | 0.6% | A | A | A |

1) Converted value: conversion value relative to 100 pbw structural monomer of binder resin.
2) PE: Polyethylene wax
3) PP: Polypropylene wax
4) Percent (%): number %

TABLE 2

| | Binder resin | | | Wax added during resin formation | | Wax added during toner kneading | | Percentage of wax particles 2 μm or larger | | Evaluations | | |
|---|---|---|---|---|---|---|---|---|---|---|---|---|
| | MN | Mw/Mn | Softening pt. (° C.) | Type (softening pt.) | Amount added (pbw; converted value) | Type (softening pt.) | Amount added (pbw; converted value) | PP wax | PE wax | Smear | Offset | Filming |
| CE 1 | 2800 | 37.0 | 117.3 | None | | PP Biscol 330P (152° C.)<br>PE Hiwax 800P (140° C.) | 3 (3.00)<br>4 (4.00) | 2.1% | 4.8% | A | B | C |
| CE 2 | 2800 | 37.0 | 117.3 | PP (Biscol 330P (152° C.)) | 3 | PE Hiwax 800P (140° C.) | 3 (3.09) | 0.9% | 3.7% | A | C | C |
| CE 3 | 4500 | 83.4 | 127.5 | PP (Biscol 550P (150° C.)) | 2 | PP Biscol 660P (145° C.) | 2 (2.04) | 23.2% | | C | A | A |
| CE 4 | 4500 | 83.4 | 127.5 | PE (Hiwax 800P (140° C.)) | 3 | PE Hiwax 400P (136° C.) | 3 (3.09) | | 25.9% | | A | C C |

TABLE 3

| | Formation time | | Amt per 100 pbw resin composition | | Per 100 pbw resin | Per 100 pbw resin | Per 100 pbw resin | Ratio of added amts. | |
|---|---|---|---|---|---|---|---|---|---|
| | Amt resin | Amt PE | Amt resin | Amt PE | Amt PE | Amt PP | Amt PP | Amt PP | Amt PE |
| Ex 1 | 200.00 | 4.00 | 98.04 | 1.96 | 2.00 | 4.00 | 4.00 | 2.04 | 1.00 |
| Ex 2 | 200.00 | 4.00 | 99.50 | 0.50 | 0.50 | 4.00 | 4.02 | 8.04 | 1.00 |
| Ex 3 | 200.00 | 6.00 | 97.09 | 2.91 | 3.00 | 3.00 | 3.09 | 1.03 | 1.00 |
| Ex 4 | 200.00 | 4.00 | 98.04 | 1.96 | 2.00 | 6.00 | 6.12 | 3.06 | 1.00 |
| Ex 5 | 200.00 | 8.00 | 96.15 | 3.85 | 4.00 | 3.00 | 3.12 | 1.00 | 1.28 |
| Ex 6 | 200.00 | 1.00 | 99.50 | 0.50 | 0.50 | 4.00 | 4.02 | 8.04 | 1.00 |
| Ex 7 | 200.00 | 6.00 | 97.09 | 2.91 | 3.00 | 3.00 | 3.09 | 1.03 | 1.99 |
| Ex 8 | 250.00 | 5.00 | 98.04 | 1.96 | 2.00 | 6.00 | 6.12 | 3.06 | 1.00 |
| CE 1 | 200.00 | 0.00 | 100.00 | 0.00 | 4.00 | 3.00 | 3.00 | 1.00 | 1.33 |
| CE 2 | 200.00 | 6.00 | 97.09 | 2.91 | 3.00 | 3.00 | 3.09 | 1.03 | 1.00 |
| CE 3 | 200.00 | 4.00 | 98.04 | 1.96 | 2.00 | 2.00 | 2.04 | 1.02 | 1.00 |
| CE 4 | 200.00 | 6.00 | 97.09 | 2.91 | 3.00 | 3.00 | 3.09 | 1.03 | 1.00 |

The mean particle size of the carrier particles used in the present invention was measured via a 280 μm aperture tube using a Coulter multisizer (Coulter, Inc.). The mean particle sizes of the toner particles were measured via a 100 μm aperture tube using the same device.

The present invention provides a toner that prevents smearing and offset during copying and prevents filming, and reduces neither toner flow characteristics nor chargeability.

Although the present invention has been fully described by way of the above description and examples, it is to be noted that various changes and modification will be apparent to those skilled in the art. Those skilled in the art will recognize, or be able to ascertain using no more than routine experimentation, many equivalents to the specific embodiments of the invention specifically described herein. Such equivalents are intended to be encompassed within the scope of the following claims.

What is claimed is:

1. A toner for developing electrostatic latent image comprising:

a resin composition containing a binder resin and a polyethylene wax added during the binder resin formation;

a polypropylene wax; and a colorant.

2. The toner of claim 1, wherein a total amount of the polyethylene wax and the polypropylene wax is about 2 to about 10 parts-by-weight relative to 100 parts-by-weight of the binder resin, and a weight ratio of the polypropylene wax and the polyethylene wax is about 10:1 to 1:10.

3. The toner of claim 1, wherein a softening point of said polypropylene wax is about 130° C. to about 160° C. and a softening point of said polyethylene wax is about 100° C. to about 150° C., and wherein the softening point of said polypropylene wax is higher than the softening point of said polyethylene wax.

4. A method for producing toner comprising the steps of:

preparing a resin composition containing a binder resin and a polyethylene wax added during the binder resin formation;

mixing the resin composition, a polypropylene wax and a colorant;

melting and kneading the mixture obtained at the mixing step;

pulverizing the kneaded mixture after the mixture has been cooled; and classifying the resulting pulverized material.

5. The method of claim 4, wherein a total amount of the polyethylene wax and the polypropylene wax is about 2 to about 10 parts-by-weight relative to 100 parts-by-weight of the binder resin, and a weight ratio of the polypropylene wax and the polyethylene wax is about 10:1 to 1:10.

6. The method of claim 4, wherein a softening point of said polypropylene wax is about 130° C. to about 160° C. and a softening point of said polyethylene wax is about 100° C. to about 150° C., and wherein the softening point of said polypropylene wax is higher than the softening point of said polyethylene wax.

7. The method of claim 4, wherein the resin composition preparing step comprises a step of preparing a monomer solution containing a monomer of the binder resin, a step of polymerizing the monomer to obtain a polymer solution, a step of mixing the polyethylene wax with the polymer solution, and a step of removing a solvent component from the polymer solution to obtain the resin composition.

8. The method of claim 4, wherein the resin composition preparing step comprises a step of mixing a monomer solution containing a monomer of the binder resin with the polyethylene wax, a step of polymerizing the monomer to obtain a polymer solution, and a step of removing a solvent component from the polymer solution to obtain the resin composition.

9. The toner of claim 1, wherein the binder resin has a number average molecular weight (Mn) of about 2,000 to about 10,000 and a ratio (Mw/Mn) of a weight average molecular weight (Mw) to the number average molecular weight (Mn) in the range of about 20 to about 90.

10. The toner of claim 1, wherein the binder resin has an acid value of about 1 KOH mg/g to about 30 KOH mg/g.

11. A toner for developing electrostatic latent image comprising:

a resin composition containing a binder resin and a polyethylene wax added during the binder resin formation;

a polypropylene wax; and a colorant, wherein at most 3% of particles of the polyethylene wax contained in the toner have a particle size of 2 μm or more.

12. The toner of claim 11, wherein 2 to 50% of the polypropylene wax contained in the toner have a particle size of 2 μm or more.

13. The toner of claim 11, wherein at most 2% of particles of the polyethylene wax contained in the toner have a particle size of 2 μm or more and 2 to 38% of the polypropylene wax contained in the toner have a particle size of 2 μm or more.

14. The toner of claim 11, wherein a total amount of the polyethylene wax and the polypropylene wax is about 2 to about 10 parts-by-weight relative to 100 parts-by-weight of the binder resin, and a weight ratio of the polypropylene wax and the polyethylene wax is about 10:1 to 1:10.

15. The toner of claim 11, wherein a softening point of said polypropylene wax is about 130° C. to about 160° C. and a softening point of said polyethylene wax is about 100° C. to about 150° C., and wherein the softening point of said polypropylene wax is higher than the softening point of said polyethylene wax.

16. The toner of claim 11, wherein the binder resin has a number average molecular weight (Mn) of about 2,000 to about 10,000 and a ratio (Mw/Mn) of a weight average molecular weight (Mw) to the number average molecular weight (Mn) in the range of about 20 to about 90.

17. The toner of claim 11, wherein the binder resin has an acid value of about 1 KOH mg/g to about 30 KOH mg/g.

* * * * *